United States Patent [19]

Brame

[11] 4,310,057

[45] Jan. 12, 1982

[54] APPARATUS FOR EXTRACTING SUBTERRANEAN GAS SAMPLES

[76] Inventor: Durward B. Brame, 2510 Richmond Dr., Arlington, Tex. 76014

[21] Appl. No.: 154,951

[22] Filed: May 30, 1980

[51] Int. Cl.[3] ..... E21B 49/08

[52] U.S. Cl. ..... 175/21; 175/59; 175/322; 173/91; 73/864.74

[58] Field of Search ..... 175/21, 58, 59, 213, 175/214, 322; 173/91, 421.5; 23/230 EP

[56] References Cited

U.S. PATENT DOCUMENTS

| | | | |
|---|---|---|---|
| 1,128,326 | 2/1915 | Kammerdiner | 175/214 |
| 2,382,992 | 8/1945 | Harris | 175/21 X |
| 3,050,095 | 8/1962 | Prather | 173/91 |
| 3,490,288 | 1/1970 | Patnode | 73/421.5 |
| 3,835,710 | 9/1974 | Pagorski | 23/230 EP |

*Primary Examiner*—William F. Pate, III

[57] ABSTRACT

An apparatus for extracting subterranean gas samples including an elongated stiff rod having a gas passageway from near the bottom end to near the top end, a means for driving the rod into the earth whereby the lower end is positioned below the earth's surface, a means to selectably open and close the gas passageway so that the passageway may be closed until the rod lower end is driven beneath the earth's surface after which the passageway may be opened, and means adjacent the upper end of the rod for extracting a gas sample from the passageway.

13 Claims, 10 Drawing Figures

APPARATUS FOR EXTRACTING SUBTERRANEAN GAS SAMPLES

BACKGROUND OF THE INVENTION

Field of the Invention

This invention relates to a device for use in determining the location of hydrocarbon products below the earth's surface. Hydrocarbons in commercial quantities exist in only a very small percent of the areas underneath the earth's surface. Various devices and processes are employed to provide information usable in formulating an intelligent decision as to the correct location for drilling oil and gas wells. Some of these techniques encompass the use of seismic exploration wherein seismic signals are generated and the reflections thereof recorded to provide indication of the shape of subterranean structures. Others employ the use of gravitometers to seek anomalies in the strength of the earth's gravitational field. The present invention is directed towards an apparatus which is usable for detecting the existence of hydrocarbons in small amounts immediately below the surface of the earth.

When pools of oil or gas exist in the earth, frequently at rather deep depths, hydrocarbon gas tends to migrate upwardly through the earth and ultimately pass through the surface of the earth into the earth's atmosphere. When the earth strata is of a tight and impervious nature, the quantities of hydrocarbon gases which gradually flow to the earth's surface are very slight and the existence of such hydrocarbons normally goes completely unnoticed. It has been discovered; however, that if samples of gas are extracted from beneath the earth's surface, it is possible to assist in the location of prospective drilling sites by locating areas where the hydrocarbon levels are greater than in other areas.

Hydrocarbon gases are generated by the decomposition of vegetable matter. It is therefore necessary to extract gas samples below the upper crust where vegetable matter exists. Therefore, it is desirable that a tool be provided to penetrate the earth's surface and extend a sufficient depth below the surface of the earth so that the gas samples extracted are representative of the hydrocarbons which exist at deep depths, indicative of oil or gas, rather than being caused by decaying vegetable matter.

It is therefore an object of the present invention to provide a device for use in making surveys of prospective locations for drilling for oil and gas by facilitating the measurement of the levels of hydrocarbon gases below the earth's surface.

More particularly, an object of the present invention is to provide a tool by which a surveyor may expeditiously penetrate the earth's surface to a selected depth and thereafter initiate a passageway between the lower end of the tool and a point above the earth's surface wherein gas samples may be extracted.

Still more particularly, an object of the present invention is to provide tools of self-contained configuration which provide a closed passageway between the lower and the upper ends thereof and including means for driving the lower end of the tool into the ground and including means wherein the passageway can be opened after the tool is driven into the ground to provide means for extracting a gas sample.

These general objects, as well as other and more specific objects of the invention, will be fulfilled in the following description and claims, taken in conjuction with the attached drawings.

SUMMARY OF THE INVENTION

This invention is a tool for expeditiously and manually driving into the earth's surface providing a means for extracting a gas sample from a point beneath the earth's surface. The device includes an elongated stiff rod having a gas passageway. The gas passageway extends from the lower end of the rod to the upper end. The rod includes an outer tubular shaft and a telescopically received longitudinally positionable inner shaft. By telescopically moving the inner shaft relative to the outer shaft, the gas passageway is closed or open. In the normal application, the gas passageway is closed and the tool is driven into the earth so that the lower end thereof is positioned at preselected distance below the earth's surface. Thereafter by telescopically moving the outer tubular shaft relative to the inner shaft, the gas passageway is opened. At the upper end of the inner shaft the gas passageway is closed, such as by means of a septum or diaphragm. The diaphragm may be penetrated, such as by a hypodermic needle, and a gas sample extracted.

To provide a means of driving the apparatus into the earth, a hammer member having an opening therethrough is slidably positioned on the exterior of the outer tubular shaft. Affixed to the outer shaft is an upper and lower stop collar. By sliding the hammer repeatedly up and down on the shaft, striking the lower stop collar, the tool can be driven into the earth or, by striking the upper stop collar, the tool can be extracted from the earth. Alternate means whereby the telescopic movement of the inner and outer shafts open and close the gas passageway are illustrated and described.

DETAILED DESCRIPTION

Figure 1:
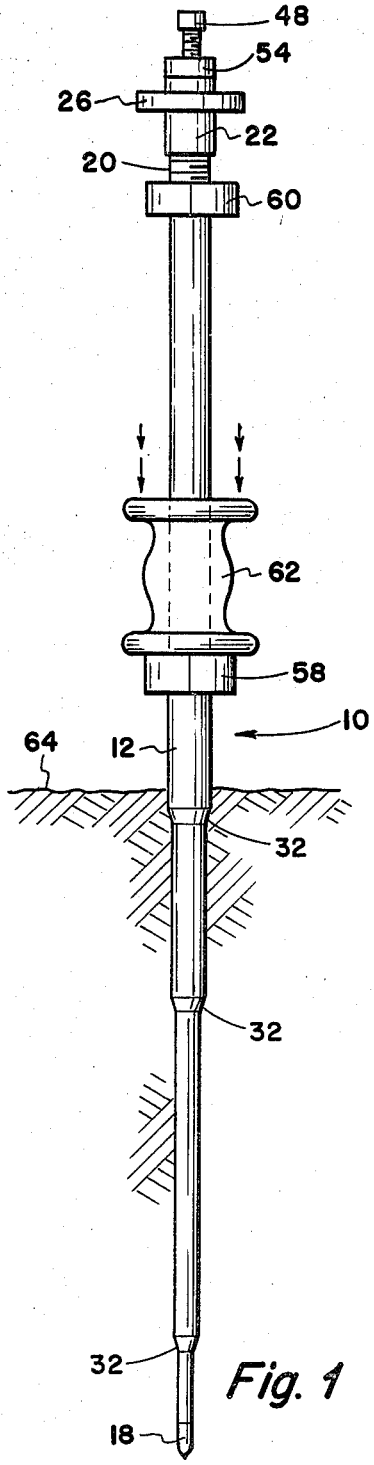
FIG. 1 is an external view of one embodiment of this invention shown driven into the earth's surface so that the lower end is at a point below the earth's surface at which a gas sample may be extracted. The tool is shown in closed condition, that is, where the passageway by which a gas sample may be extracted is closed.
Figure 2:
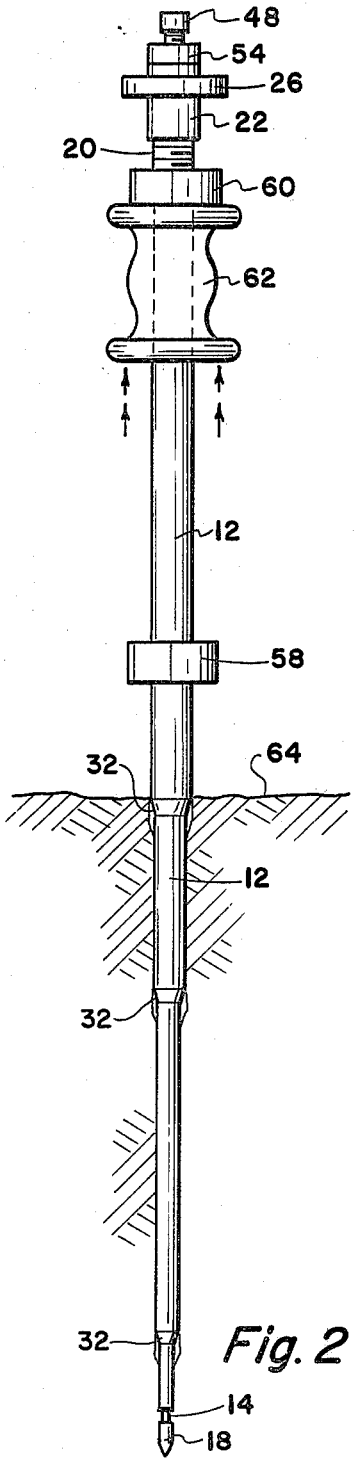
FIG. 2 shows the tool of FIG. 1 in which the passageway has been opened, providing communication between the lower end of the tool and the upper end so that a gas sample may be extracted.
Figure 3:
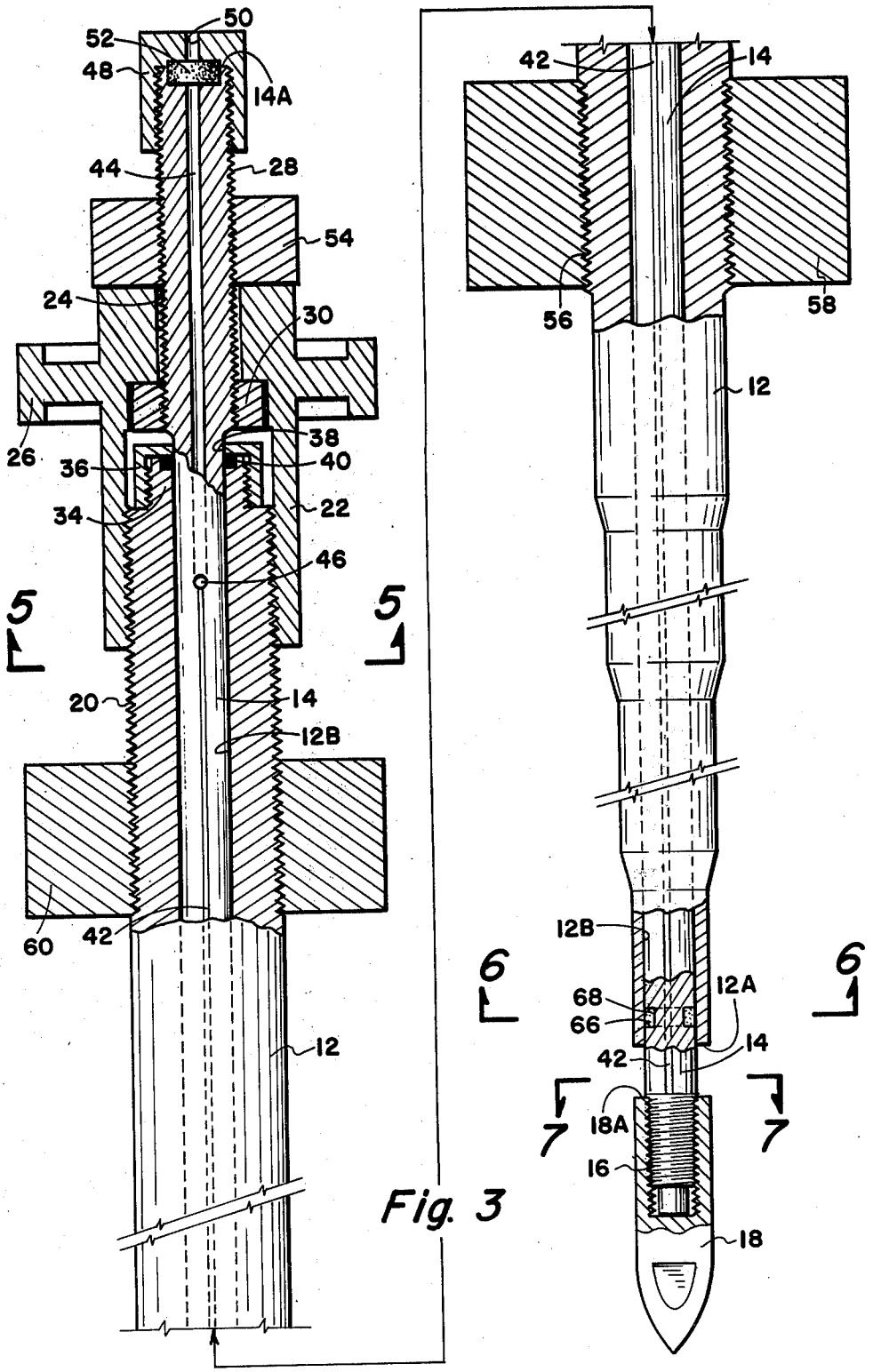
FIG. 3 is an enlarged and exploded elevational view shown partially in cross-section of the tools of FIGS. 1 and 2 and showing the tool in the open position as in FIG. 2.

Referring now to FIGS. 1, 2, and 3, a preferred embodiment of the invention is illustrated. As shown in FIG. 1, the apparatus of the invention for extracting subterranean gas samples includes an elongated stiff rod generally indicated by the numeral 10. The rod 10 preferably is in the form of an outer tubular shaft 12 which may be tapered as illustrated in FIGS. 1 and 2 and in the lower portion of FIG. 3. Slidably and telescopically received within the outer tubular shaft 12 is an inner shaft 14. The lower end of inner shaft 14 is threaded at 16 and includes a point member 18 which is internally threaded. The lower end 16 and point member 18 are exterior of and below the lower end 12A of the outer tubular shaft.

The upper end of outer tubular shaft 12 is threaded at 20 and receives an internally threaded tubular collar 22. The upper end of collar 22 has an opening 24 therein which slidably receives the upper end of inner shaft 14. The exterior periphery of collar 22 includes an integral hand ring 26 by which the collar 22 may be rotated on the threaded upper end 20 of outer tubular shaft 12.

The upper end of inner shaft 14 is threaded at 28 and receives an internally threaded stop collar 30. The exterior surface of shaft 12 is provided with a sequence of spaced-apart tapers 32 as shown in FIG. 1. These tapered areas serve to provide improved sealing of the exterior of the shaft with the earth to prevent gas from passing downwardly exterior of the shaft.

The upper end of outer tubular shaft 12 is of reduced diameter at 34 and is externally threaded to receive an internally threaded cap 36 having an opening 38 therein which slidably receives the inner shaft 14. Positioned between the upper end of the outer tubular shaft 12 and cap 36 is a gasket 40. The function of gasket 40 is to seal the exterior of the inner shaft 14 relative to the interior annular opening 12B of the outer shaft 12.

Figure 5:
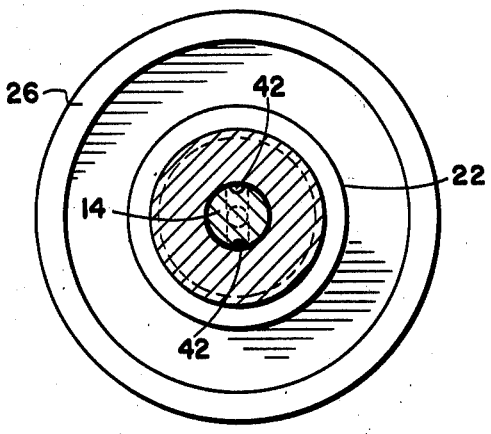
FIG. 5 is a cross-sectional view taken along the line 5—5 of FIG. 3.
Figure 7:
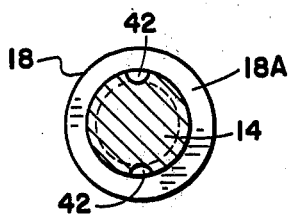
FIG. 7 is a cross-sectional view taken along the line 7—7 of FIG. 3.
Figure 6:
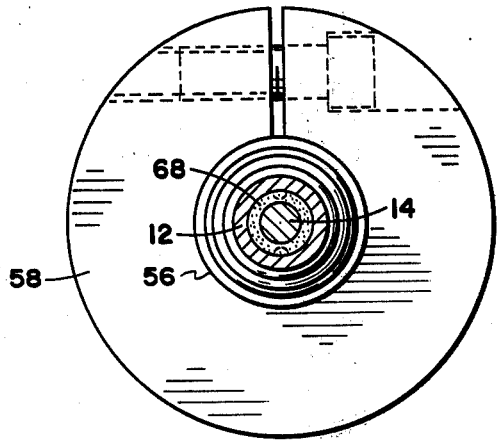
FIG. 6 is a cross-sectional view taken along the line 6—6 of FIG. 3.

Formed in the exterior surface of the lower portion of the inner shaft 14 is one or more grooves 42 (two being shown in the embodiment illustrated in cross-sectional FIGS. 5 and 7). The upper end of the inner shaft 14 is provided with an axial passageway 44 which extends from the top end 14A of the inner shaft downwardly to a radial opening 46 which passes through the shaft to communicate with the slots 42 formed on opposite sides of the shaft. Thus, the passageway 44 communicates with slots 42.

An internally threaded cap 48 is threadably positioned on the upper end of internal shaft 14, the cap having an axial opening 50 therein. Positioned between the cap and the upper end 14A of the internal shaft is a frangible closure member or septum or diaphragm 52, the purpose of which will be described subsequently.

Threadably positioned on the upper threaded end 28 of the inner shaft 14 above collar 22 and below cap 48 is an internally threaded stop member 54. When collar 22 is rotated to move upwardly, the inner shaft 14 is drawn upwardly into closed position, as shown in FIG. 1, in which the upper end 18A of the point member 18 is in engagement with the lower end 12A of outer shaft 12. When it is desired to cause telescopic movement of the inner shaft 14 within outer shaft 12 to cause the separation of point member 18 from the lower end of the outer shaft, the collar 22 is rotated relative to shaft 12, by means of the hand ring 26, to apply force to member 50 to extend the inner shaft to the position shown in FIG. 2 to provide spacing between the lower end of the outer member 12 and thus provide exterior communication with the lower end of the slots 42.

The outer terminal shaft 12 is threaded at an intermediate point at its length, the threads being identified by the numeral 56, and these threads receive an internally threaded lower stop collar 58. In like manner, the upper external threads 20 receive an internal thread upper stop collar 60. Positioned between stop collars 58 and 60 and slidable on the exterior of the outer tubular shaft 12 is a tubular hammer member 62 as shown in FIGS. 1 and 2, but not seen in FIG. 3. The hammer member can be manually reciprocated up and down on the exterior of the outer shaft 12 to drive the apparatus into the ground or to remove from the ground and, as will be described subsequently, to open the device for taking a gas sample.

OPERATION

When it is desired to take a gas sample, the instrument is sealed closed so that the upper ends 18A of pointed member 18 is drawn into sealed engagement with the lower end 12A of the outer shaft. This is accomplished by engagement of stop member 54 with collar 22 and is easiest accomplished by rotating the collar using the hand ring 26. This closes the passageway formed by slots 42, radial opening 46, and internal passageway 44, the passageway being sealed at the top by septum 52. If desirable, the passageway can be purged with an inert gas. The apparatus is then ready to be driven into the ground to extract a gas sample.

To position the apparatus in the earth, it is set uprightly on the surface of the earth with the pointed member 18 on the surface. The hammer 62 is raised upwardly and rapidly forced downwardly to strike the lower stop collar 58. A repetition of this motion drives the instrument into the ground so that, as shown in FIG. 1, the lower pointed end 18 extends beneath the earth's surface 64. The depth of the lower pointed end 18 is preferably as great as possible, but it has been found that it should be at least 18 inches below the earth's surface to avoid the effect of decaying vegetable matter.

After the instrument has been driven into the ground to the position as shown in FIG. 1, it is ready to provide means of extracting a gas sample. The next action is to rotate collar 22 downwardly so as to force rod 14 downwardly in relation to tube 12. The gas passageway at 12A is opened only slightly about 1/64 inch to be sufficient for withdrawing a gas sample. This permits the slots 42 in the exterior surface of the inner shaft 14 to be exposed. Gas is then free to pass upwardly through the slots 42, into the radial opening 46 and to the inner passageway 44. This gas sample may be extracted by inserting the needle of a syringe (not shown) through the opening 50 in cap 48 to penetrate septum 52. A quantity of gas may then be drawn upwardly through the apparatus, the quantity being any amount desired for test purposes. The quantity drawn into the syringe may be analyzed to determine the quantity of hydrocarbon content.

In mapping a prospective area, the user injects the probe and takes a gas sample by the steps above-described in a grid arrangement. By comparing the relative concentrations of hydrocarbons, the area of greatest promise for the location of commercial quantities of oil and gas can be localized.

As shown in the right-hand portion of FIG. 3, the inner shaft 14 may include a circumferential groove 66 in the outer surface which retains a filter 68. The filter prevents entrance of dirt or other contamination into the upper portion of slots 42.

ALTERNATE EMBODIMENTS

Figure 4A:
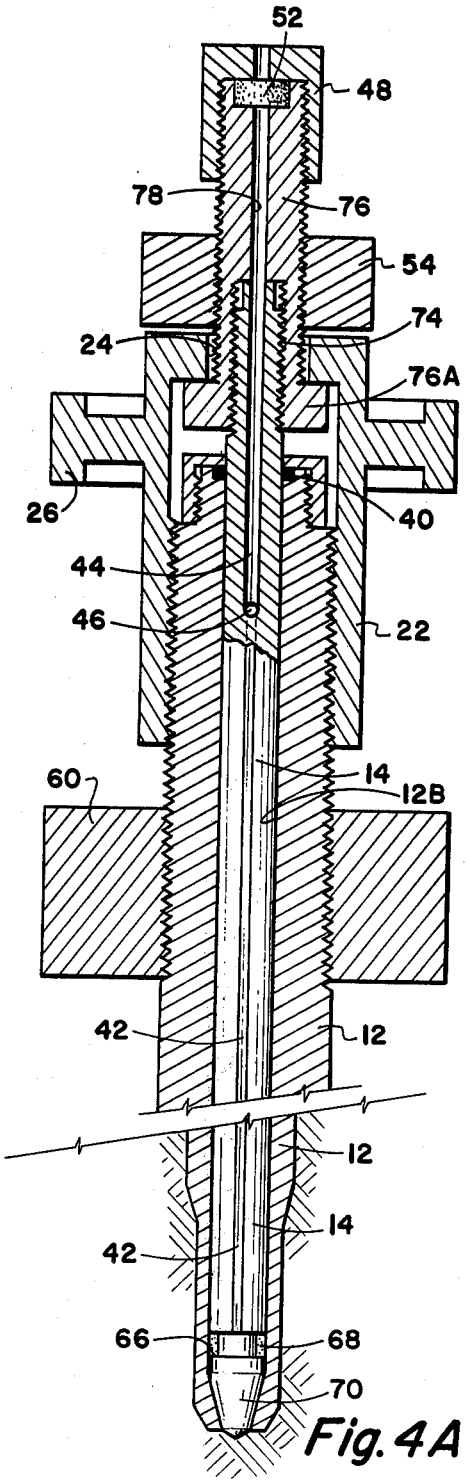
FIG. 4A is a fragmentary elevational cross-sectional view of an alternative embodiment of the tool of this invention shown in closed position.
Figure 4B:
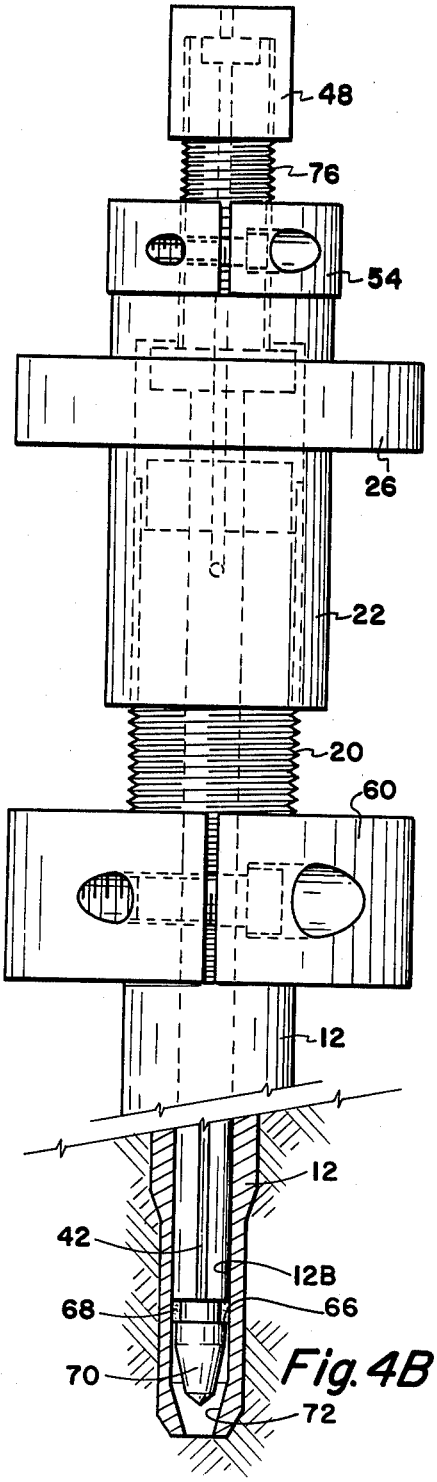
FIG. 4B is an elevational view, shown partially in cross-section, of the tool of FIG. 4A shown in open position.

The preferred embodiment described with reference to FIGS. 1, 2, and 3 can be altered in a variety of ways, all in keeping with the concepts of the invention. FIGS. 4A and 4B show such an alternate embodiment. In this arrangement the inner shaft 14 has an integral tapered portion 70 at the lower end. Above the tapered end is a circumferential groove 66 with a filter 68 therein. The groove 66 communicates with slots 42. The maximum external diameter of the integral tapered portion 70 is of a reduced maximum external diameter compared to the normal internal diameter 12B of the lower portion of the outer tubular shaft 12. The lower end of the outer tubular shaft is internally tapered at 72 to matingly receive, when in its lower downward position, the tapered portion 70 of the inner shaft. Thus, in the arrangement of FIGS. 4A and 4B, the unit is sealed in closed position by the downward position of the internal shaft 14 relative to the outer shaft 12 which is opposite that arrangement as shown in FIGS. 1, 2, and 3.

After the device of FIGS. 4A and 4B is installed in the earth, in the same manner as described with reference to the embodiment of FIGS. 1, 2, and 3, the slots 42 can be exposed to receive the upper passage of gas therethrough by the upwardly threaded rotation of collar 22. This rotation applies pressure against the stop member 54, raising the inner shaft 14.

The upper arrangement of the apparatus in the embodiment of FIGS. 4A and 4B is slightly different. The upper end of inner shaft 14 is threaded at 74 and threadably receives a shaft extension 76 which is also externally threaded. The shaft extension has an axial passageway 78 therein which aligns with passageway 44 in the inner shaft 14. The shaft extension 76 threadably receives the cap 48 and supports the septum 52 as previously described. The lower end of shaft extension 78 includes an integral enlarged external diameter portion 76A which functions to limit the relative travel of the inner shaft 14. In addition, the enlarged internal diameter portion 76A forms a shoulder so that the downward threaded movement of collar 22 against portion 76A forces the inner shaft 14 downwardly into the sealed position such as shown in 4A. In this embodiment inner shaft 14 is moved downwardly relative to outer shaft 12 to close the passageway, opposite to that of the other embodiments.

It can be seen that in this embodiment of the invention the hammer member (not shown in FIGS. 4A and 4B is usable for driving the device into the earth but is not employed in closing or opening the passageways.

The comparison of the embodiment of FIGS. 4A and 4B to that of FIGS. 1, 2, and 3 illustrates the fact that a variety of alternate arrangements may be made in the device without departing from the basic concepts thereof.

Figure 8A:
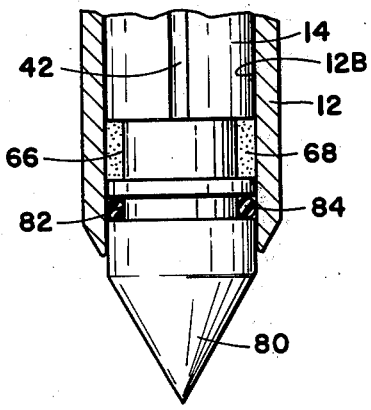
FIG. 8A is a fragmentary elevational view shown partially in cross-section of the lower end of a tool showing an alternate embodiment of the invention.
Figure 8B:
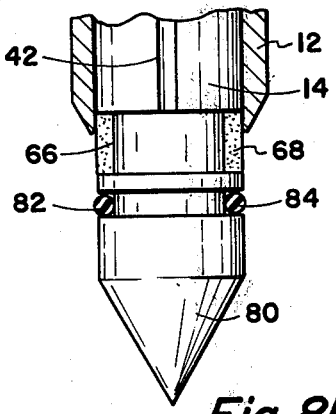
FIG. 8B is a view as in FIG. 8A but showing the tool in the open position.

FIGS. 8A and 8B show an additional alternate arrangement of the lower end of the apparatus. In this arrangement the inner shaft 14 is provided with an integral tapered lower end 80, the maximum external diameter of which is substantially equal the internal diameter of the lower end of the outer tubular shaft 12. A groove 66 is provided in the external surface of the inner shaft 14 above the lower pointed end 40 and including the filter 68 which serves to filter gas passing into slots 42. To more effectively seal the external surface of the inner shaft 14 to the interior opening 12B of the outer shaft, an additional groove 82 is formed in the inner shaft 14 below groove 66. Positioned in groove 82 is an O-ring gasket 84, which, when the inner shaft 14 is in the upward, closed position as shown in FIG. 8A, forms a hermetic seal to close the slots 42. The arrangement of FIGS. 8A and 8B may be utilized in a free point embodiment of the invention.

It can be seen that various means may be provided for moving the inner shaft relative to the outer shaft so that the gas passageways are closed while the apparatus is being inserted into the earth and opened after the lower end of the shaft 10 has been extended to the desired depth. In this way an accurate sample of the gas existing in the earth at a preselected depth can be taken. It is important in practicing the invention that the samples being taken represent gas emanating upwardly from subterranean formations and not that generated by vegetative matter near the earth's surface. By the provision of this invention wherein the passageways through which gas samples are taken are securely sealed and closed while the instrument is being inserted, and then opened after the instrument has been driven into the earth, more effective and useful information can be obtained for oil and gas exploration.

The invention has been illustrated in arrangements wherein the subterranean gas samples can travel upwardly in the probe in grooves on the inner shaft exterior surface, or through an axial opening in the inner shaft. It can be seen, though not illustrated, that gas can be conducted in an annular area between the exterior of the inner shaft 14 and the interior surface of outer tubular shaft 12. While the invention has been described as it relates to extracting subterranean hydrocarbon gas samples, it is apparent that any other type of gas may also be detected, such as helium, using the probe of this invention.

While the invention has been described with a great degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element or step is entitled.

What is claimed is:

1. Apparatus for extracting subterranean gas samples comprising:

an elongated stiff rod pointed on the lower end and having a gas passageway from adjacent the lower end to adjacent the upper end thereof, the rod being formed of an outer tubular shaft and a telescopingly received inner shaft longitudinally positionable relative to said outer shaft, said gas passageway being opened and closed by relative movement of said inner and outer shafts, means for driving said rod into the earth whereby the lower end thereof is below the earth's surface;

a collar means rotatably received on said outer tubular shaft having means rotatably engaging said inner shaft providing means to telescopically move said inner shaft relative to said outer shaft to open and close said gas passageway whereby said passageway may be closed until said rod lower end is driven beneath the earth's surface, after which said passageway may be opened; and means adjacent the upper end of said rod for extracting a gas sample from said gas passageway.

2. Apparatus for extracting subterranean gas samples according to claim 1 wherein said outer tubular shaft is externally threaded adjacent the upper end thereof, wherein said collar means threadably receives said outer shaft and wherein said collar has an integral inwardly extending reduced internal diameter portion receiving said inner shaft, and including:

an upper and lower stop member affixed to said inner shaft on either side of said collar reduced diameter portion whereby when said collar is rotated it threadably advances relative to said outer shaft to thereby axially displace said inner shaft.

3. Apparatus for extracting subterranean gas samples according to claim 1 wherein said inner shaft is formed in part by a lower pointed end extending beyond the lower end of said outer shaft, and means cooperating between said inner shaft end and said outer shaft lower end to seal said passageway when said inner shaft is upwardly positioned relative to said outer shaft and to open said passageway when said inner shaft is telescopically extended relative to said outer shaft.

4. Apparatus for extracting subterranean gas samples according to claim 1 including:

a frangible septum closing said passageway adjacent the upper end of said rod, the septum being puncturable whereby a gas sample may be taken therethrough.

5. Apparatus for extracting subterranean gas samples according to claim 1 wherein said means for driving said rod into the earth comprises;

a hammer member having an opening therethrough and being slidably received on said rod intermediate the upper and lower ends; and a stop collar affixed exteriorally to said rod below said hammer member of a diameter greater than said opening in said hammer member, whereby said hammer member may be manually reciprocated to impact against said stop collar.

6. Apparatus for extracting subterranean gas samples according to claim 5 including:

an upper stop collar affixed externally to said rod above said hammer of a diameter greater than said opening in said hammer, whereby said hammer member may be manually reciprocated to impact against said upper collar to extract said rod from the earth.

7. Apparatus for extracting subterranean gas samples according to claim 1 including:

filter means in said gas passageway for intercepting solid particles.

8. Apparatus for extracting subterranean gas samples comprising:

an outer tubular shaft having a gas passageway from adjacent the lower end to adjacent the upper end thereof;

a telescopingly received inner shaft longitudinally positionable relative to said outer shaft, said gas passageway being opened and closed by relative movement of said inner and outer shafts, said outer and inner shafts providing a stiff rod pointed on the lower end, means for driving said stiff rod into the earth whereby the lower end thereof is below the earth's surface;

means to selectably open and close said gas passageway whereby said passageway may be closed until said rod lower end is driven beneath the earth's surface, after which said passageway may be opened;

means adjacent the upper end of said rod for extracting a gas sample from said gas passageway; and wherein said outer tubular shaft is defined by at least one transition from a larger exterior diameter upper portion to a smaller exterior diameter lower portion providing a frusto-conical transition area spaced above said rod pointed lower end, said transition area providing a ground seal when said rod is driven into the ground.

9. Apparatus for extracting subterranean gas samples according to claim 4 wherein said inner shaft is formed in part by a lower pointed end extending beyond the lower end of said outer shaft, and means cooperating between said inner shaft end and said outer shaft lower end to seal said passageway when said inner shaft is upwardly positioned relative to said outer shaft and to open said passageway when said inner shaft is telescopically extended relative to said outer shaft.

10. Apparatus for extracting subterranean gas samples according to claim 8 including:

a frangible septum closing said passageway adjacent the upper end of said rod, the septum being puncturable whereby a gas sample may be taken therethrough.

11. Apparatus for extracting subterranean gas samples according to claim 8 wherein said means for driving said rod into the earth comprises;

a hammer member having an opening therethrough and being slidably received on said rod intermediate the upper and lower ends; and a stop collar affixed exteriorly to said rod below said hammer member of a diameter greater than said opening in said hammer member, whereby said hammer member may be manually reciprocated to impact against said stop collar.

12. Apparatus for extracting subterranean gas samples according to claim 5 including:

an upper stop collar affixed externally to said rod above said hammer of a diameter greater than said opening in said hammer, whereby said hammer member may be manually reciprocated to impact against said upper collar to extract said rod from the earth.

13. Apparatus for extracting subterranean gas samples according to claim 8 including:

filter means in said gas passageway for intercepting solid particles.

* * * * *